US006210629B1

(12) United States Patent
Brückner et al.

(10) Patent No.: US 6,210,629 B1
(45) Date of Patent: Apr. 3, 2001

(54) METHOD AND DEVICE FOR DISCONTINUOUS PARTING OFF OF MOLTEN MASS

(75) Inventors: Raimund Brückner, Engenhahn-Niedernhausen; Daniel Grimm, Bad Schwalbach, both of (DE); Richard Ardell, Loveland, OH (US)

(73) Assignee: Didier-Werke AG, Wiesbaden (DE)

( * ) Notice: Subject to any disclaimer, the term of this patent is extended or adjusted under 35 U.S.C. 154(b) by 0 days.

(21) Appl. No.: 09/284,118

(22) PCT Filed: Oct. 6, 1997

(86) PCT No.: PCT/EP97/05469

§ 371 Date: Apr. 8, 1999

§ 102(e) Date: Apr. 8, 1999

(87) PCT Pub. No.: WO98/15374

PCT Pub. Date: Apr. 16, 1998

(30) Foreign Application Priority Data

Oct. 8, 1996 (DE) ..... 196 41 169

(51) Int. Cl.[7] ..... C21B 7/12

(52) U.S. Cl. ..... 266/45; 266/237; 222/590; 222/592

(58) Field of Search ..... 266/45, 236, 237; 222/590, 592, 597, 600

(56) References Cited

U.S. PATENT DOCUMENTS

| | | | | |
|---|---|---|---|---|
| 5,348,566 | * | 9/1994 | Sawyer et al. | 75/10.24 |
| 5,350,159 | * | 9/1994 | Parker | 266/237 |
| 5,939,016 | * | 8/1999 | Mathiesesn et al. | 266/45 |
| 5,968,447 | * | 10/1999 | Pavlicevic et al. | 266/45 |

FOREIGN PATENT DOCUMENTS

| | | |
|---|---|---|
| 1049547 | 1/1959 | (DE) . |
| 3427940 | 2/1986 | (DE) . |
| 4428297 | 2/1996 | (DE) . |

* cited by examiner

*Primary Examiner*—Scott Kastler
(74) *Attorney, Agent, or Firm*—Wenderoth, Lind & Ponack, L.L.P.

(57) ABSTRACT

The invention pertains to a process and an apparatus for the discontinuous tapping of melts. An inductor surrounds a passage through which the melt is discharged from a vessel. The inductor applies radial electromagnetic energy to the passage to maintain the melt in a molten state. To stop flow of the melt through the passage, an outlet opening of the passage is closed and the inductor is electrically switched off while a cooling medium is flowed through the inductor. To begin flow of the melt, the outlet opening of the passage is opened and the inductor is electrically switched on.

20 Claims, 1 Drawing Sheet

METHOD AND DEVICE FOR DISCONTINUOUS PARTING OFF OF MOLTEN MASS

BACKGROUND OF THE INVENTION

The invention relates to a process for the discontinuous tapping of melts, e.g. metal melts such as liquid steel, or fusible non-metals, from a vessel through a passage. Furthermore, the invention relates to an arrangement for carrying out the process.

During the discontinuous tapping of the melt, the melt outflow is intentionally interrupted while the vessel remains more or less filled, in order to start the tapping operation at a subsequent time. After the interruption of the melt outflow, the melt freezes in the passage and forms a plug there. The plug must be removed before the renewed tapping operation can begin. According to the prior art, the plug is melted by an oxygen lance. For this purpose the lance must be guided from below the vessel which is a dangerous operating process.

A discontinuous tapping of melts takes place, for example, in disposal melting installations.

SUMMARY OF THE INVENTION

It is an object of the invention to provide an operationally safe tapping operation and a corresponding arrangement.

The above object is solved by performing a tapping operation in which the melt flow is interrupted at the outlet of the passage such that it solidifies within the passage. Renewed tapping results when the interruption is ceased and the solidified melt is melted by applying radial electromagnetic energy thereto.

The melt flow is stopped by actuating the interruption. The melt is subsequently allowed to solidify in the passage, whereby a reliable double closure of the vessel is attained. To start in the melt flow again, the interruption is ceased and the melt plug is melted by applying radial electromagnetic energy thereto. This operation is also operationally safe since the use of an oxygen lance is no longer necessary.

During the renewed tapping, the interruption can be ceased first and subsequently the solidified melt can be melted. However, preferably the renewed tapping occurs as a result of first melting the solidified melt in the passage and then ceasing the interruption. This is possible because the melting does not take place through an oxygen lance, but rather through application of radial electromagnetic energy. This approach has an advantage in that the solidified melt on the structural part forming the interruption is melted before the structural part is moved mechanically. Movement of the structural part is thus not hindered by the solidified melt.

The application of the electromagnetic energy preferably takes place by inductively coupling an electromagnetic filed to the solidified melt and/or to the passage. If the melt is a metal melt, it becomes coupled intrinsically to the electromagnetic field of an inductor. However, it is also possible that the passage comprises an inductively couplable material In this case, the energy is transferred to the melt through thermal conduction and/or heat radiation.

In a further development of the invention, the cooling and solidification of the melt in the passage after the interruption of the melt flow by virtue of cooling an inductor provided for the application of the electromagnetic energy is assisted by electrically switching off the inductor. Thus, a melt plug blocking the passage is formed rapidly.

In order to prevent the melt plug from bursting the passage during the melting, the melting of the solidified or completely rigidified melt plug takes place so rapidly that a thin margin zone or the melt plug is liquified before a temperature equalization occurs throughout the melt plug. Through the melt plug expanding during the melting, the liquified material of the margin zone is displaced upwardly or downwardly such that the passage does not burst due to the expansion of the melt plug. The danger of the passage bursting can also be eliminated by heating the passage just in advance of the frozen melt such that the passage expands to such an extent that the melt melt plug expands into the additional space created by heating the passage. In this case, the passage comprises a material which becomes inductively coupled to the electromagnetic field of the inductor due to the high temperature of the melt e.g., a ceramic material.

An arrangement for carrying out the described process is characterized in that in a melting vessel is disposed a passage, in particular a sleeve, whose exit can be closed and opened by virtue of a known mechanical adjusting element arrangement. The passage is surrounded by an inductor, in particular an air-cooled inductor whose electromagnetic filed becomes coupled directly to the melt and/or the passage. Thus, because the passage itself is surrounded by the inductor, it is ensured that the melt plug is subjected to the electromagnetic energy.

The known adjusting element arrangement can be a plate with an aperture and a closing face. It can also comprise a blind plate and an aperture plate or nozzle.

For electromagnetic shielding of a metal mounting with which the arrangement is fastened on the vessel, ferrite cores can be provided.

BRIEF DESCRIPTION OF THE DRAWING

The sole FIGURE describes an embodiment of the invention. Therein is shown:

a partial section of a metallurgical vessel with a blind plate and an interchanging nozzle.

Figure 1:
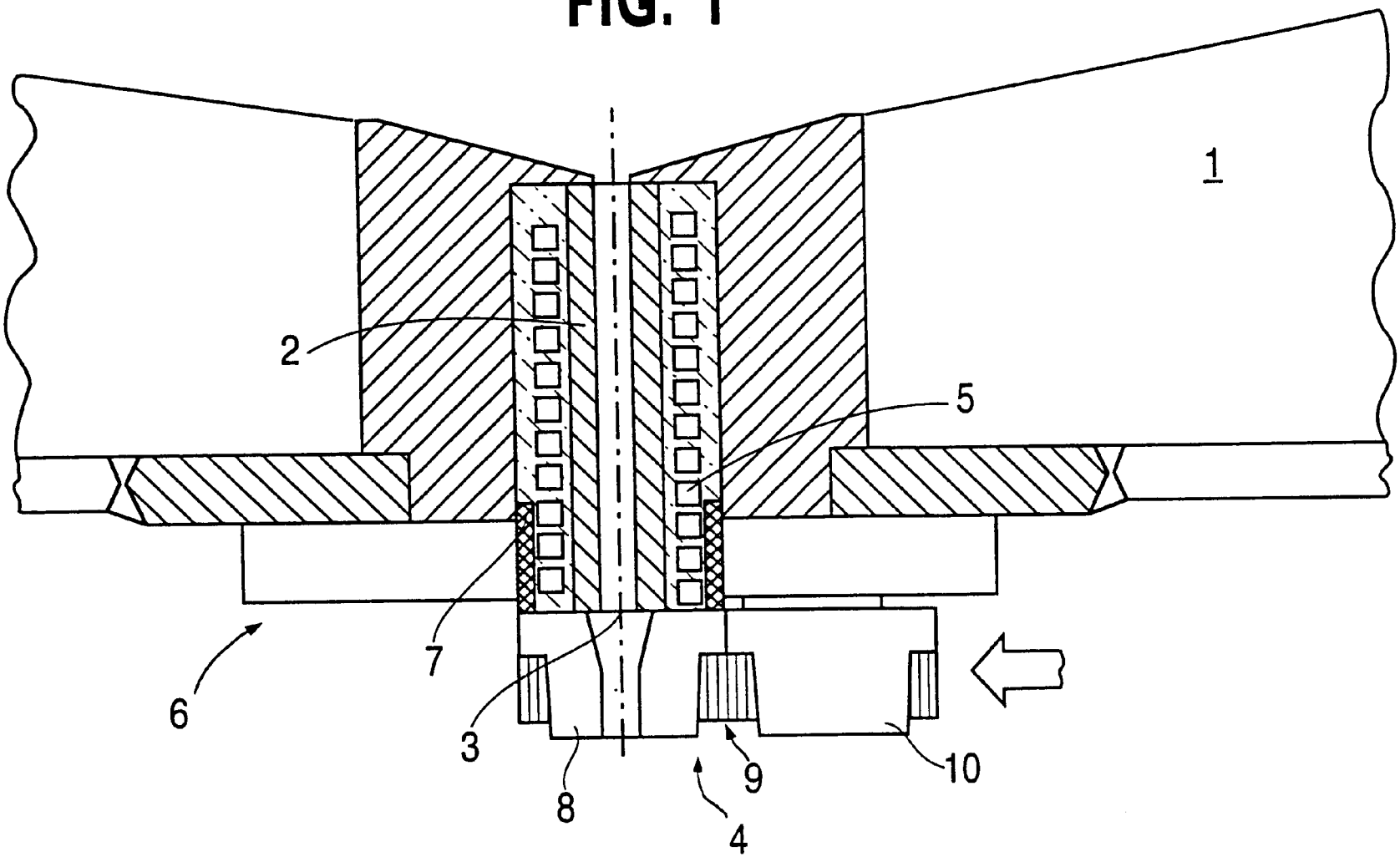

Into the bottom (1) of a metallurgical vessel is provided, as a passage for the melt, a sleeve (2) comprising a refractory ceramic material. The sleeve (2) forms an exit opening (3) for the melt, whereby the exit opening (3) adjoins a mechanical adjusting element arrangement (4) with which the exit opening (3) can be closed and opened.

The sleeve (2) is surrounded by an inductor (5) through whose hollow cross sectional profile flows a cooling medium, in particular air. The inductor (5) extends as close as possible to the exit opening (3). For electrical shielding of a metallic mounting (6) of the adjusting element arrangement (4) ferrite cores (7) can be provided.

In the mounting (6), the adjusting element arrangement (4) is displaceably guided. In the embodiment according to the FIGURE the adjusting element arrangement (4) comprises an interchanging nozzle (8) or aperture plate, and a blind plate (10). Both the nozzle (8) and the blind plate (10) are displaceable in guidance structure (9) of the mounting (6) in such a way that when the blind plate (10) is slid beneath the exit opening (3), it pushes the interchanging nozzle (8) away from the exit opening (3), whereupon the blind plate (10) blocks the exit opening (3). When the interchanging nozzle (8) is pushed subsequently it pushes the blind plate (10) away from the exit opening (3) with the interchanging nozzle (8) arriving under the exit opening (3).

However, any other known interruption of the melt flow is also conceivable, such as, for example, a puddling copper slag introduced from below into the sleeve (2) or a ceramic stopper (not shown) introduced from above into the sleeve (2).

The operational function of the described embodiment is substantially the following: if the melt flow is to be stopped, the interchanging nozzle (8) is pushed away from the exit opening (3) by virtue of the blind plate (10) until the blind plate (10) blocks the exit opening (3). Alternatively, a puddling slag or stopper is introduced into the sleeve (2).

Therewith the melt flow is primarily interrupted. The melt is subsequently allowed to freeze entirely or partially in the sleeve (2). This can be accelerated by electrically switching off the inductor (5), while a cooling medium circulates through the inductor (5), such that in the sleeve (2) a melt plug is formed which provides a secondary closure.

If the melt is to be tapped again from the vessel, the inductor (5) is electrically switched on whereby a radial electromagnetic energy is applied to the melt plug in the sleeve (2) such that the melt plug becomes melted. The melt plug is thereby also melted in a region on the blind plate (10) or the closing face such that the melt plug at least becomes viscous, whereby the blind plate (10) can be pushed away from the exit opening (3) by virtue of the interchanging nozzle (8), such that its aperture is disposed under the exit opening (3). Consequently, the melt flow is enabled again.

During the melting of the melt plug located in the sleeve (2), the sleeve (2) is exposed to stress loading due to the fact that the melt plug expands radially when melting, such that the danger exists that the sleeve (2) breaks or tears. This problem is avoided in the described embodiment because, by virtue of the inductor (5) a thin margin zone of the melt plug becomes the liquid or viscous before a temperature equalization occurs throughout the melt plug, which temperature equalization would result in expansion of the melt plug over its entire cross sectional area. The margin zone, becoming liquid or viscous in advance of the remainder of the melt plug allows the melt plug during its further expansion to be pressed upwardly if the exit opening (3) is still closed, or downwardly and upwardly if the exit opening (3) is not closed such that the sleeve (2) is exposed at most to a low radial inner pressure.

The stated problem can also be circumvented by causing the sleeve (2), under the effect of the inductor (5) as a function of the temperature, to expand so far that the subsequent expansion of the melt plug occurs in the additional space created by the sleeve expansion. The melting of the thin margin zone and the expansion of the sleeve (2) can occur simultaneously.

In the embodiment the melt flow is interrupted at the exit opening (3), and is solidified by cooling in the passage. It is also possible to interrupt the melt flow by virtue of a closure puddling slag or a stopper.

What is claimed is:

1. A process for the discontinuous tapping of melts, comprising:

interrupting flow of a melt from a vessel through a passage;

flowing a cooling medium through an inductor that surrounds said passage while said inductor is electrically switched off, whereby the melt solidifies within said passage;

ceasing the interruption of the flow of the melt through said passage; and electrically switching on said inductor, whereby radial electromagnetic energy is applied to the solidified melt within said passage such that the solidified melt within said passage becomes molten and flows through said passage.

2. The process according to claim 1, wherein said melt is selected from the group consisting of a metal and a fusible non-metal.

3. The process according to claim 2, wherein the interrupting of the flow of the melt is performed prior to the flowing of a cooling medium through the inductor.

4. The process according to claim 3, wherein the electrically switching on of the inductor is performed prior to the ceasing of the interruption of the flow of said melt, such that said melt within said passage becomes molten prior to ceasing the interruption of the flow of said melt.

5. The process according to claim 3, wherein the electrically switching on of said inductor results in the radial electromagnetic energy being applied to said solidified melt such that said solidified melt becomes molten at a rate whereby a margin zone of said solidified melt becomes molten before a temperature equalization occurs throughout said solidified melt.

6. The process according to claim 3, and further comprising heating said passage prior to applying the radial electromagnetic energy to said solidified melt, whereby said passage expands to such an extent that upon application of the radial electromagnetic energy to said solidified melt, said solidified melt is free to expand within said passage as said solidified melt becomes molten.

7. The process according to claim 2, wherein said melt is steel.

8. The process according to claim 1, wherein the interrupting of the flow of the melt is performed prior to the flowing of a cooling medium through the inductor.

9. The process according to claim 1, wherein the electrically switching on of the inductor is performed prior to the ceasing of the interruption of the flow of said melt, such that said melt within said passage becomes molten prior to ceasing the interruption of the flow of said melt.

10. The process according to claim 1, wherein the electrically switching on of said inductor results in the radial electromagnetic energy being applied to said solidified melt such that said solidified melt becomes molten at a rate whereby a margin zone of said solidified melt becomes molten before a temperature equalization occurs throughout said solidified melt.

11. The process according to claim 1, and further comprising heating said passage prior to applying the radial electromagnetic energy to said solidified melt, whereby said passage expands to such an extent that upon application of the radial electromagnetic energy to said solidified melt, said solidified melt is free to expand within said passage as said solidified melt becomes molten.

12. An apparatus for performing discontinuous tapping of metal melts or fusible nonmetal melts, comprising:

a vessel having an interior, a passage interconnecting the interior of said vessel with an exterior of said vessel, and having an exit opening;

a member to open and close said exit opening; and an inductor surrounding said passage, wherein said inductor has a hollow passageway for flowing of a cooling medium therethrough, such that a melt in said passage can be solidified by closing said exit opening with said member and flowing a cooling medium through said hollow passageway of said inductor, and a solidified melt in said passage can be melted by electrically switching on said inductor so that electromagnetic energy is applied to the solidified melt.

13. The apparatus according to claim 12, wherein said passage comprises a sleeve.

14. The apparatus according to claim 13, wherein said sleeve comprises a ceramic material.

15. The apparatus according to claim 13, wherein said member comprises a plate having an aperture and a closing portion, such that when said exit opening is to be opened said aperture is aligned with said exit opening, and when said exit opening is to be closed said closing portion is aligned with said exit opening.

16. The apparatus according to claim 13, wherein said member comprises a closing plate and a an aperture plate having an aperture therethrough, such that when said exit opening is to be opened said aperture plate is positioned across said exit opening such that said aperture is aligned with said exit opening, and when said exit opening is to be closed said closing plate is positioned across said exit opening.

17. The apparatus according to claim 13, wherein said member comprises a closing plate and a nozzle, such that when said exit opening is to be opened said nozzle is aligned with said exit opening, and when said exit opening is to be closed said closing plate is positioned across said exit opening.

18. The apparatus according to claim 12, wherein said member comprises a plate having an aperture and a closing portion, such that when said exit opening is to be opened said aperture is aligned with said exit opening, and when said exit opening is to be closed said closing portion is aligned with said exit opening.

19. The apparatus according to claim 12, wherein said member comprises a closing plate and a an aperture plate having an aperture therethrough such that when said exit opening is to be opened said aperture plate is positioned across said exit opening such that said aperture is aligned with said exit opening, and when said exit opening is to be closed said closing plate is positioned across said exit opening.

20. The apparatus according to claim 12, wherein said member comprises a closing plate and a nozzle, such that when said exit opening is to be opened said nozzle is aligned with said exit opening, and when said exit opening is to be closed said closing plate is positioned across said exit opening.

* * * * *